United States Patent [19]

Good

[11] 4,143,849

[45] Mar. 13, 1979

[54] MOLD FOR FORMING JOINTS BETWEEN CONDUITS

[76] Inventor: Gary L. Good, 117 E. Maple St., Cleona, Pa. 17042

[21] Appl. No.: 874,254

[22] Filed: Feb. 1, 1978

[51] Int. Cl.[2] ..... B28B 7/28

[52] U.S. Cl. ..... 249/11; 249/145; 249/183

[58] Field of Search ..... 249/1, 10–12, 249/145, 183, 184

[56] References Cited

U.S. PATENT DOCUMENTS

| | | | |
|---|---|---|---|
| 405,652 | 6/1889 | Baade | 249/11 |
| 725,098 | 4/1903 | Learned | 249/11 |
| 3,734,450 | 5/1973 | Lengel | 249/12 |
| 4,085,918 | 4/1978 | Wilkerson | 249/11 |

*Primary Examiner*—Roy Lake
*Assistant Examiner*—John McQuade
*Attorney, Agent, or Firm*—Thomas Hooker

[57] ABSTRACT

A mold for forming joints between a pair of pipes, such as sewer pipes extending into a man hole, where the mold includes a pair of mold parts extendable into the interiors of the pipes and having on first ends interengagable means for joining the mold parts together at one angular orientation and having on second ends interengagable means for joining the mold parts together at a different angular orientation so that one set of mold parts may be used to form joints between pairs of pipes in either of two orientations.

10 Claims, 6 Drawing Figures

MOLD FOR FORMING JOINTS BETWEEN CONDUITS

This invention relates to a mold for forming a smooth continuous passage or joint between a pair of pipes, conventionally sanitary sewer pipes extending into a man hole. It is conventional to hand lay up cement work in the bottom of the man hole and to trowel in a passage connecting the two pipes or to use wooden framing to provide a mold for the passage. This framing occupies most of the space within the man hole and makes it difficult or impossible to pour cement around the framing and to vibrate the cement after it is poured. Both these conventional methods of forming the desired passage or joint between the two pipes are expensive and time consuming. Further, a wooden framing adaptable to form a passage between 180° oriented pipes can not be used to form the passage between 90° oriented pipes. Conventional molds or forms for connecting pipes in man holes are disclosed in U.S. Pat. Nos. 405,652, 725,098 and 3,734,450.

The mold of the present invention comprises a pair of light flexible fiberglass mold parts each having a generally C-shaped transverse cross section with flexible side walls and a relatively rigid bottom portion located between the side walls. The exterior surfaces of the mold parts lie on a cylinder so that when the mold parts are fitted together in one position they are co-axial and may be used as an invert mold to form a joint between two 180° oriented pipes. When the mold parts are fitted together in a second position they may be used as an invert mold to form a 90° joint extending from two 90° oriented pipes.

A first end of one of mold part interlocks with a first end of the other mold part to form a straight 180° mold and a second end of the first mold part interlocks with a second end of the other mold part to form a 90° mold. The respective pairs of ends are interlocked and aligned together to assure that they form an invert mold with a smooth surface extending between the two pipes.

When the mold parts are used to form a 180° joint they are preferrably held in place by a long brace extending from one pipe to the other and wedged into place against the bottom interior of the mold parts. When the mold parts are used to form a 90° joint braces are wedged into place in the mouths of the pipes and L-shaped weights rest on the mold parts at their junction in the center of the man hole. These weights and long brace prevent undesired lifting up the mold parts during pouring and vibrating of the concrete.

Through the use of the invention it is possible to form a smooth molded passage between two sewer pipes without the necessity of either hand troweling the passage or erecting cumbersome wooden molds. The rapid positioning of the mold parts in place prior to pouring of the concrete and the ease of which they may be removed from the man hole materially reduces the amount of time and labor required to cement the bottom of man holes. By using a pair of mold parts, as contrasted to a single long mold part handling of the mold parts within the man hole section is facilitated.

The mold parts described herein are provided with alignment means on their ends to enable them to be placed together in either a straight or 180° position or in a right angle or 90° position. Other types of alignment means may be provided for the mold parts so that they may be used to form joints between pipes oriented at different angles with respect to each other for instance, a set of mold parts may have 60° and 45° orientation end sections for use in forming joints between pipes oriented at 60° or 45°.

Other objects and features of the invention will become apparent as the description proceeds, especially when taken in conjunction with the accompanying drawings illustrating the invention of which there are two sheets.

IN THE DRAWING:

FIG. 1 is a perspective view illustrating mold parts and accessories according to the invention;

Figure 7:
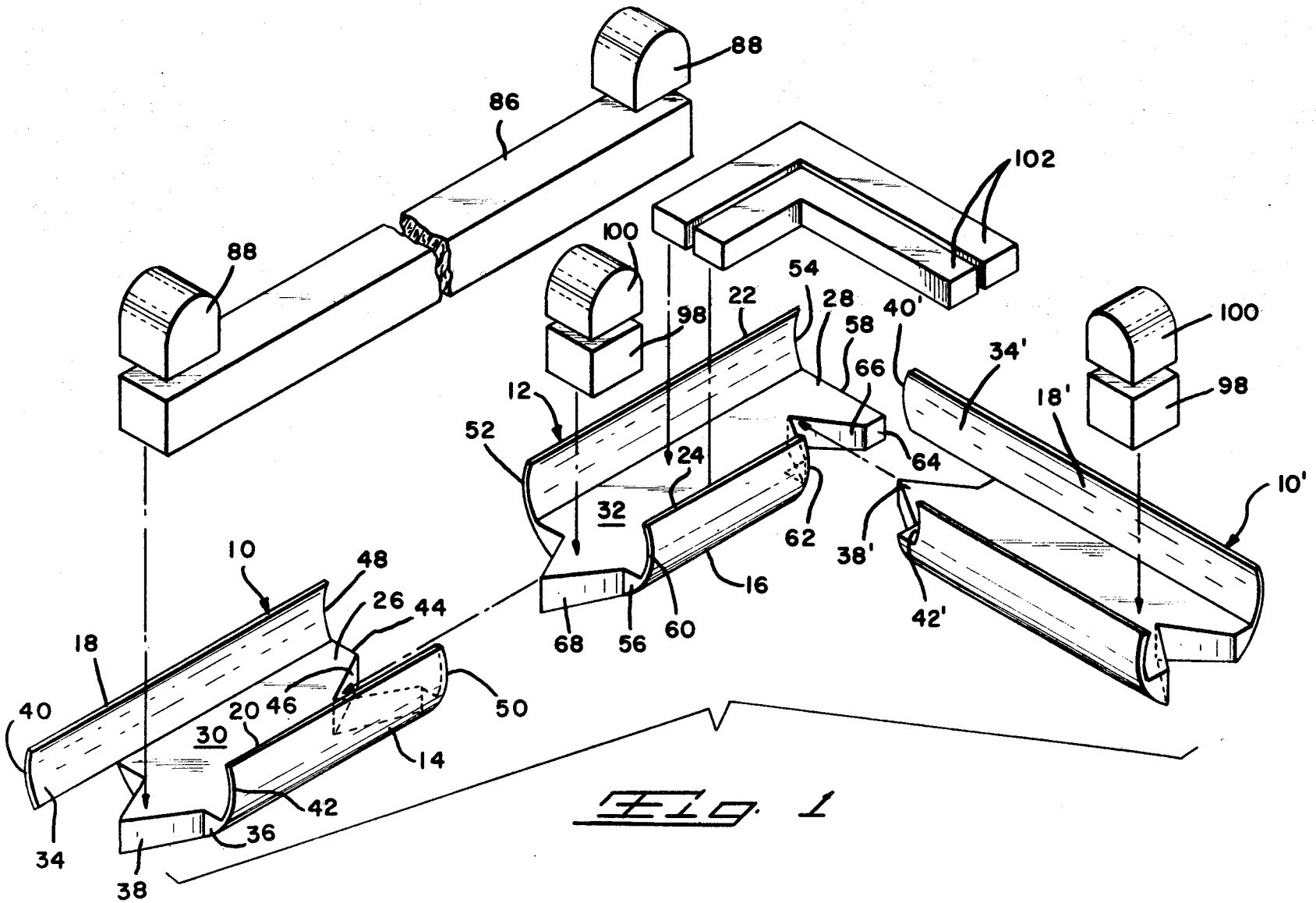

FIG. 1 illustrates a pair of fiberglass mold parts 10 and 12 each having a partial cylindrical exterior surface 14 and 16 with relatively-thin upstanding side walls 18, 20, 22 and 24. Each mold part includes a rigid bottom portion 26, 28 between a flat upper surface 30, 32 and the adjacent bottom cylindrical exterior surface 14, 16.

In mold part 10 side wall 20 extends along the full length of bottom portion 26. The opposite side wall 18 also extends along the length of the portion 26 and includes a portion 34 extending beyond 36 of the base. Alignment point 38 projects beyond bottom 26 at end 36 a distance somewhat less than side wall portion 34. The end edge 40 of side wall portion 34 is convex and edge 42 of side wall 20 adjacent bottom end 36 is concave. At the end opposite 44 of the bottom 26 the ends 48 and 50 of side walls 18 and 20 are straight and lie flush with the end of the bottom. A V-shaped alignment recess 46 is formed in end 44 between the two side walls.

In mold part 12 the side wall 22 runs the length of bottom 28 and has straight edges 52 and 54 at bottom ends 56 and 58. Side wall 24 extends from straight end edge 60 at bottom end 56 to concave end edge 62 located a distance short of bottom end 58. A recessed side surface 64 extends from side wall 62 to end 58. V-shaped alignment recess 66 is formed in surface 64 and is complementary with alignment point 38 of mold part 10. An alignment point 68 extends from end 56 and is complementary with alignment recess 46 of mold part 10.

The mold parts 10 and 12 are used to form an integral mold joining pairs of either 180° opposed sanitary sewer pipes or sanitary pipes positioned at 90° with respect to each other. Conventionally, the mold is used to join pipes extending into the bottom of a man hole section. Such a mold for joining 180° oriented sanitary sewers may be made by joining the two mold part 10 and 12 together with point 68 seated within V-shaped alignment recess 46 as indicated in FIG. 1. When in this position, bottom ends 44 and 56 are flush, the straight side wall edges 48, 50, 52 and 60 are flush and surfaces 14 and 16 are coextensive.

The same two mold parts 10 and 12 may also be used to form a 90°-mold for joining sanitary sewers at 90°. The 90° mold is formed by seating alignment point 38 within recess 66. This relationship is indicated in FIG. 1 where mold part time 10' corresponds to mold part 10 and alignment point 38' of part 10' may be seated within recess 66 of mold part 12. With the two mold parts positioned together in this manner a tight joint is formed between the two bottom portions and a correspondently tight joint is formed between extension 34' of side wall 18' and bottom end 58; and side wall ends 40' and 54 and 42' and 62.

Figure 2:
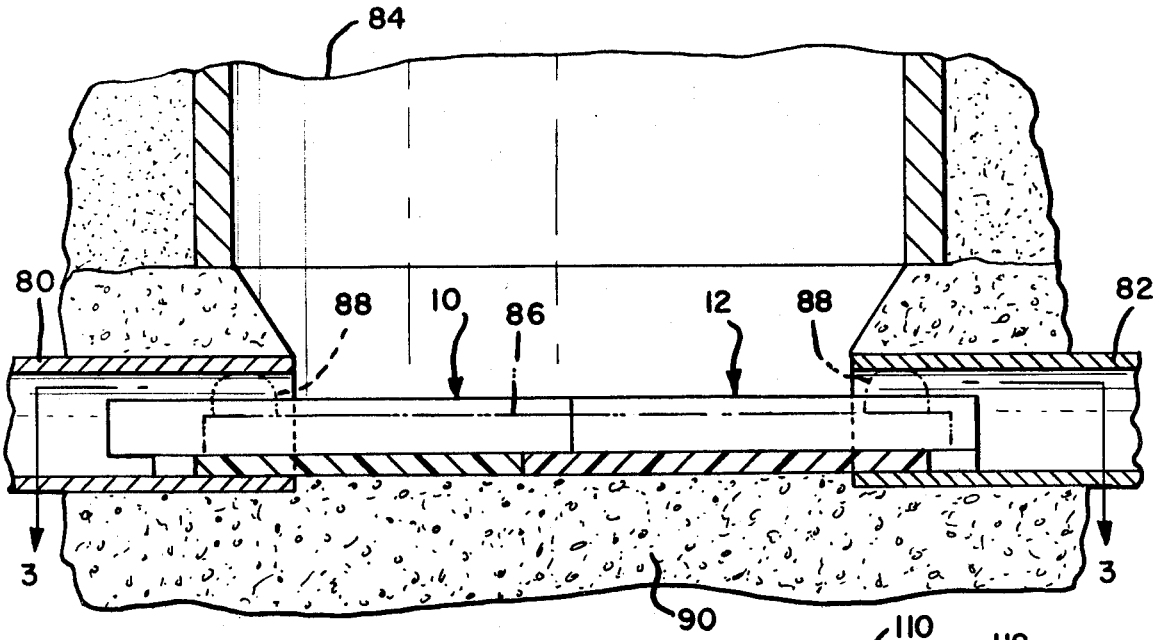
FIG. 2 is a vertical sectional view taken through the bottom of a man hole illustrating the use of the invention in connecting a pair of 180° opposed sanitary sewer pipes.
Figure 3:
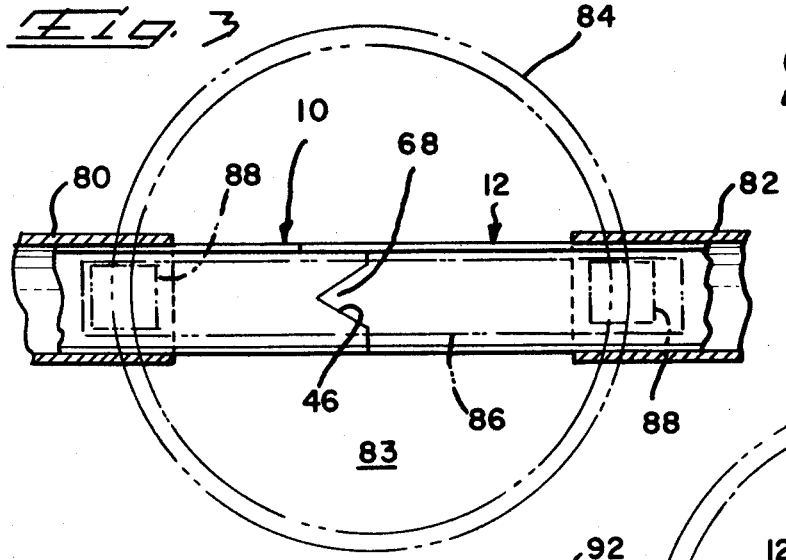
FIG. 3 is a sectional view taken along line 3—3 of FIG. 2.

FIG. 2 illustrates the use of mold parts 10 and 12 in forming a molded concrete passage or joint between two 180° oriented sanitary sewer pipes 80 and 82. Conventionally, a pre-cast man hole section 84 is placed above the ends of the pipes 80 and 82. The volume beneath the section is excavated to expose the ends of the pipes. The exterior cylindrical surfaces 14 and 16 of mold parts 10 and 12 conform to the interior diameters of the sewer pipes. Different diameter mold parts may be used with different diameter sewer pipes. The mold parts are inserted into the pipes 80 and 82 by first moving either end 58 of mold part 12 into one of the pipes or moving end 36 of mold part 10 into the other pipe. After the first mold part is in place second mold part may similarly be moved within the end of the other pipe and the two mold parts can be brought together so that the alignment point 68 is seated within the alignment recess 46 and the two surfaces 30 and 32 are flush. The flexibility of the side walls 18, 20, 22 and 24 facilitates insertion of the mold parts into the pipes. Seating of the point 68 within recess 46 aligns the mold parts with respect to each other so that the external cylindrical surface 14 and 16 are coextensive.

The aligned mold parts are held in position with respect to each other by laying a brace 86 on the surfaces 30 and 32 thereof with the ends of the brace extending into the open ends of pipes 80 and 82. Wedges 88 may then be driven between the top of the base and the tops of the pipes to hold the mold parts against relative movement during pouring and vibrating of concrete.

Following bracing of the mold parts a mass of concrete 90 is poured in the bottom of the manhole section 84 to surround the pipes 80 and 82 and the mold. The concrete is vibrated to assure proper fillage and is then troweled smooth to provide the desired finish. The surface 83 at the bottom of the man hole is flush with the tops of the mold part side walls. The concrete is then allowed to set, conventionally for a half hour or more, and then the wedges 88 and brace 86 may be removed and the mold parts 10 and 12 may be snapped out of the pipes 80 and 82 and removed from the surrounding partially solidified concrete, leaving the desired passage or joint connecting the two pipes.

Figure 4:
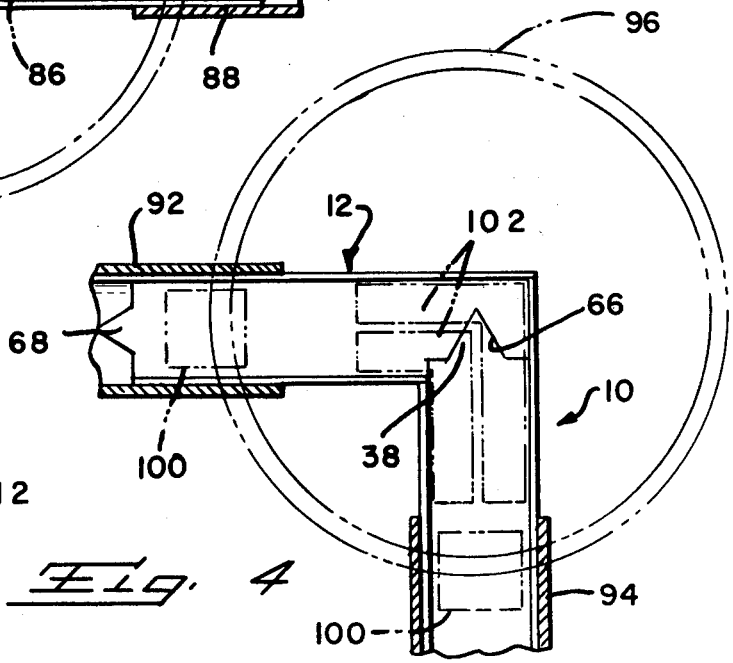
FIG. 4 is a view similar to FIG. 3 illustrating the use of the invention to form a trough between sanitary sewer pipes arranged at an angle of 90°.

FIG. 4 illustrates the use of mold parts 10 and 12 to form a passage connecting 90° oriented sewer pipes 92 and 94. These pipes are located beneath a man hole section 96. Mold parts 10 and 12 have a close fit within the interior of the pipes 92 and 94.

As illustrated, the end of mold part 12 carrying alignment point 68 is positioned within the end of pipe 92 and the end of mold part 10 carrying alignment recess 46 inserted within the end of pipe 94. The two mold parts are then adjusted with respect to their respective pipes so that alignment point 38 is seated within alignment recess 66 and the surfaces 30 and 32 are flush. When in this position, the exterior cylindrical surfaces of the two mold parts join at a 90° angle to form a continuous surface extending from pipe 92 to pipe 94.

Following positioning of the two mold parts 10 and 12 the parts are wedged into place within the two pipes by means of blocks and wedges 100. L-shaped weights 102 are then placed on the surfaces 30 and 32 at the 90° joint between the mold parts to prevent lifting of the mold during pouring of concrete around the parts.

Following positioning of the mold parts as described concrete is poured into the space between the mold parts and the man hole section as described previously and is vibrated and then troweled. After the concrete is set the weights, blocks and wedges may be removed and the mold parts may be removed from the man hole leaving a smooth continuous passage or joint extending between the two pipes.

Figure 5:
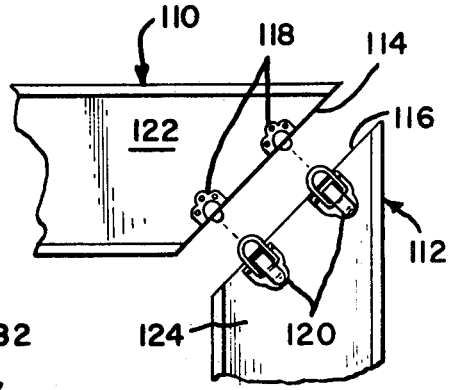
FIGS. 5 and 6 are views like FIG. 4 showing a different 90° connection between the mold parts.
Figure 6:
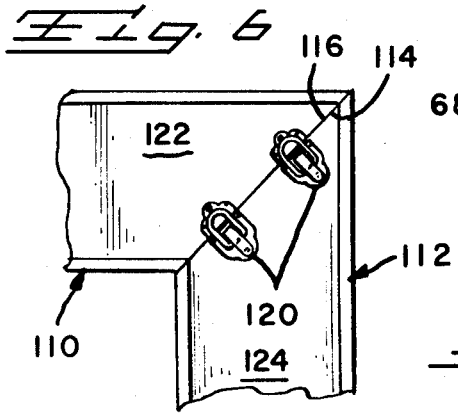

FIGS. 5 and 6 illustrate mold parts 110 and 112 which are identical to mold parts 10 and 12 with the exception that different end structure is used to form the 90° joint. The ends of mold parts 110 and 112 used to form the 180° joint are identical to ends previously described in connection with mold parts 10 and 12.

FIG. 5 illustrates the mold parts 110 and 112 positioned closely adjacent to each other in approximately 90° orientation. Each part includes a 45° beveled end surface 114, 116 such that when the mold parts are brought together to form the 90° joint, as illustrated in FIG. 6, the exterior cylindrical surfaces of the two mold parts form a continuous 90° invert mold. The mold parts are held together by a pair of toggle clips mounted on the flat upper surfaces 120 and 122 of the two mold parts. Each clip includes a male portion 118 having a projection which extends into a recess in a female portion 120 and a toggle-type clamp used to hold the two portions together with the projections seated within the recesses. Seating of the projections within the recesses orients the mold parts accurately with respect to each other so that the complementary surfaces 114 and 116 are brought together and the exterior surfaces form a continuous 90° mold as illustrated in FIG. 6.

Mold parts 110 and 112 may be used to form 180° invert molds as desired in exactly the same manner as mold parts 10 and 12. Alignment clips may be used to orient the two mold parts in the 180° mold if desired. When used to form a 90° invert mold, the mold is held in place through the use of weights, blocks and wedges in exactly the same manner as previously described.

While I have illustrated and described preferred embodiment of my invention, it is understood that this is capable of modification, and I therefore do not wish to be limited to the precise details set forth, but desire to avail myself of such changes and alterations as fall within the purview of the following claims.

What I claimed as my invention is:

1. A mold for forming a molded joint between ends of pairs of pipes, said mold comprising a pair of mold parts each having a channel shaped transverse cross section with a partial cylindrical outer surface, flexible upstanding side walls and a bottom section joining the side walls; a first pair of alignment members comprising a first alignment member at one end of a first mold part and a second alignment member at one end of the other mold part, the alignment members each including interengagable mold part orienting surfaces such that when the orienting surfaces are brought together the mold parts are joined together at a first angular orientation with the side walls and bottom sections thereof joining each other to form a continuous mold; and a second pair of alignment members comprising a third alignment member at the other end of said first mold part and a fourth alignment member at the other end of said other mold part, said third and fourth alignment members each including interengagable mold part orienting surfaces such that when such orienting surfaces of the third and fourth alignment members are brought together the mold parts are aligned at a second angular orientation with the side walls and bottom sections thereof joining each other to form a second mold for forming a joint between pipes at a second angular orientation.

2. A mold as in claim 1 wherein said first pair of alignment members orients said mold parts to form a straight joint between 180° oriented pipes and said second pair of alignment members orients said mold parts at 90° to form a joint between 90° oriented pipes.

3. A mold as in claim 2 wherein each pair of alignment members includes a projection on one mold part and a complementary recess conforming in shape to the projection on the other mold part whereby seating of the projection into the recess orients the mold parts with respect to each other.

4. A mold as in claim 3 wherein all of said alignment members form parts of the bottom sections of their respective mold parts.

5. A mold as in claim 4 wherein the recess of said second pair of alignment members is located on one side of its respective mold part adjacent the other end of such mold part and one side wall of the other mold part extends longitudinally beyond the other end of such mold part to form the side wall of the 90° mold.

6. A mold as in claim 5 wherein said mold parts are formed from a glass fiber plastic material with said side walls being relatively thin to permit flexing during positioning of the mold parts in the ends of the pipes and with said bottom sections having a thickness greater than the thickness of said side walls to provide desired rigidity.

7. A mold as in claim 1 wherein each pair of alignment members includes a projection and a complementary recess.

8. A mold as in claim 1 wherein the first pair of alignment members comprises a projection on one mold part, a recess on the other mold part and clamp means holding the one ends of the mold parts together with the projection in the recess.

9. A mold as in claim 8 wherein the one ends of the mold parts include beveled complementary end surfaces such that when the end surfaces are held together the exterior surfaces of the mold parts form a continuous angled mold.

10. A mold as in claim 9 wherein the first pair of alignment members include a pair of toggle clips secured to the inside surfaces of the mold parts and spaced along the beveled end surfaces; each clip including a member having a recess on one mold part, a member having a projection on the other mold part and a clamp for holding the two members together with the projection seated within the recess.

* * * * *